United States Patent [19]

Yealy

[11] Patent Number: 4,607,806

[45] Date of Patent: Aug. 26, 1986

[54] CABLE REEL WITH REINFORCING FLANGES

[75] Inventor: Carl F. Yealy, New Oxford, Pa.

[73] Assignee: Merline Industries, Inc., Hanover, Pa.

[21] Appl. No.: 811,369

[22] Filed: Dec. 20, 1985

[51] Int. Cl.[4] ..... B65H 75/14

[52] U.S. Cl. ..... 242/117; 242/118.7

[58] Field of Search ..... 242/71.8, 117, 118.4, 242/118.7, 118.8; 156/73.1–73.5, 294

[56] References Cited

U.S. PATENT DOCUMENTS 4,403,749 9/1983 Nakagawa ..... 242/71.8

4,511,417 4/1985 Yealy ..... 156/73.5

*Primary Examiner*—Leonard D. Christian

*Attorney, Agent, or Firm*—Daniel J. O'Connor

[57] ABSTRACT

A cable reel having cardboard ends and core which are reinforced by a hollow plastic axis haing flanges secured to each end, the flanges pressing against the outer surfaces of the ends and being held to the axis by sonic-welding.

1 Claim, 2 Drawing Figures

CABLE REEL WITH REINFORCING FLANGES

This invention relates to reels for storage of cable or rope and in particular reels with end plates which are secured to a central hollow core by means of glueing or other adhesives.

RELATED PATENTS

This invention is related to, but an improvement over, applicant's prior U.S. Pat. No. 4,511,417 issued Apr. 16, 1985.

BACKGROUND OF THE INVENTION

As described in my prior patent, it is known in the prior art to form a cable reel by means of securing end plates, usually of circular configuration, to a hollow central core. For small reels or reels designed for storage of lightweight material, the central core is usually of a laminated paper stock material cylindrically wound and of heavy weight. The end plates are made of heavy weight corrugated cardboard material which are secured to the annular end surfaces of a hollow core by compatible adhesives.

The end plates are often composed of two layers of material, the outer layer being in the form of a circle having a relatively small hole at its center and the inner layer having a relatively large opening, just slightly larger than the outer diameter of the center core to which the end plate will be secured. When these inner and outer layers are securely fastened together, the inner surface of each end plate has a center depressed circular area which will receive the central core of the reel to be assembled and furnish two surfaces for adhesive securing. That is, one surface on the annular end surface of the hollow central core and the other surface on the inner circular surface defined by the opening in the inner layer.

Despite the fact that two glueing surfaces are available in the known reels, it is still a common problem for the end plates to become separated from the central core, due to rough handling and tearing of the cardboard material. In my prior U.S. Pat. No. 4,511,417, this cardboard reel was reinforced by a plastic axis extending through the hollow center of the core, with a plastic flange spin-welded to each end thereof. This is a satisfactory reel, except that in the process of spin-welding the ends of the reel are sometimes damaged by the spinning tool.

SUMMARY OF THE INVENTION

It is an object of the present invention to form a reel having plastic flanges which are strongly secured to the central core of the reel by use of a cylindrical member of plastics material extending along the axis of the reel, and having flanges secured to each end of that central member by means of sonic welding. These flanges are positioned tightly against the outer surface of each end plate so as to reinforce the reel structure and make it considerably stronger than reels known in the prior art, since instead of a smooth inner surface on each flange (to permit spin-welding), there is at least one lug or cylindrical plastic protuberance, spaced from the center of the flange, which engages a hole in the outer face of the cardboard reel end.

It is a further object of this invention to teach a method of assembling such a reel without the necessity of any potentially dangerous power tools used to fasten plastic materials together by spin-welding.

These and other objects of the invention will become apparent from the following description, which is given by way of example only with illustration of a preferred embodiment as shown in the attached drawings.

DETAILED DESCRIPTION OF A PREFERRED EMBODIMENT

Figure 1:
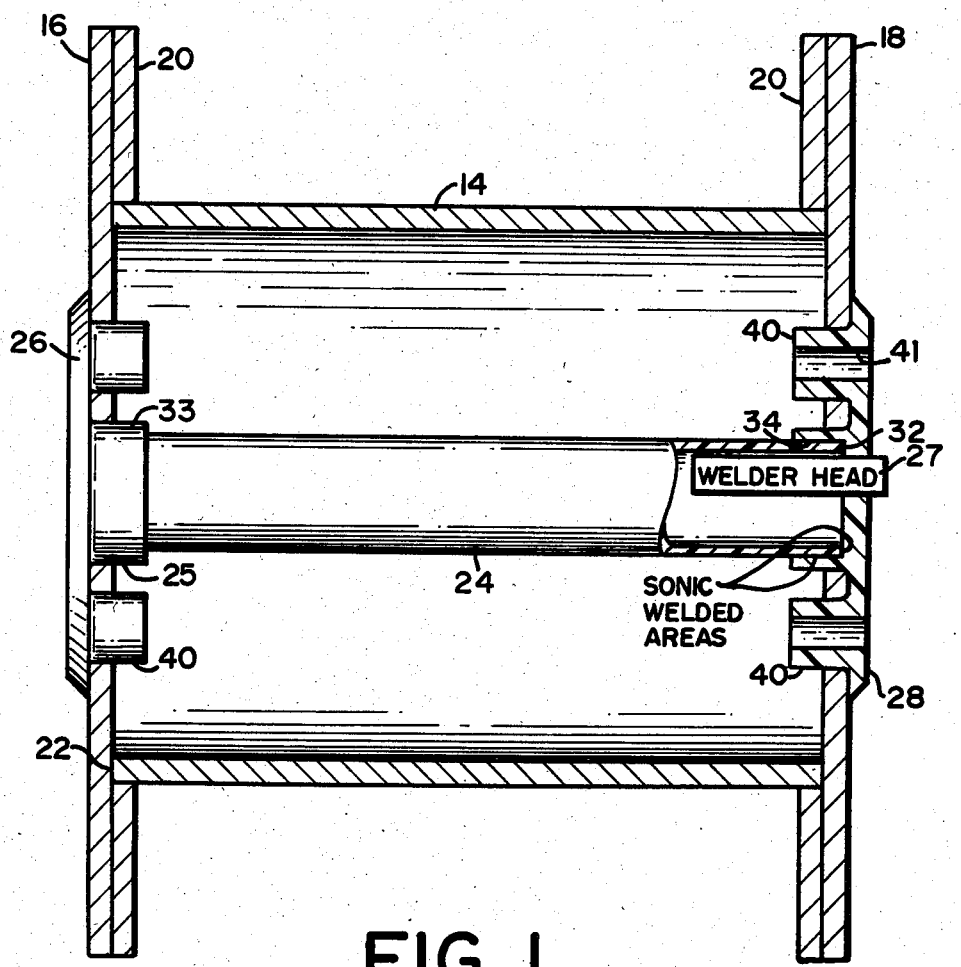
FIG. 1 is a sectional view through a reel, showing end plates held to a hollow central core and reinforced by means of external flanges.

FIG. 1 is a sectional view taken through a reel of the present invention, the section being cut approximately through and parallel to the central axis thereof. A hollow core 14, preferably of helically or convolutedly wound craft paper material is positioned between first end plate 16 and second end plate 18. Each end plate 16 and 18 has an outer layer of corrugated cardboard and a second (inner) layer 20 which is adhesively secured to the inner surface of the outer layer. That inner layer has a circular opening of approximately the same size as the outer diameter of holow core 14. The edge of the circular opening thus forms inner facing offset 22 and bears against the outer surface of the hollow core 14, and centers it in relation to end plates 16 and 18. Such a reel is known in the prior art, and glue or other adhesive is used along offset 22 and on the annular end of core 14 to hold the reel together. As previously mentioned, such securing has not proved satisfactory in the prior art and such reels are now reinforced by a spin-welded central cylindrical member. In heavier reels, the core and end plates may be made of other materials, such a wood or plastics, but problems of weakness of the end plates still may be present.

Figure 2:
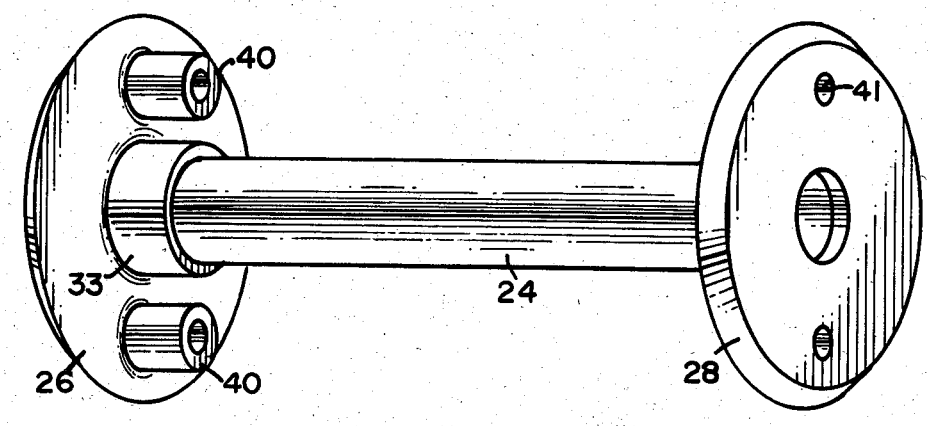
FIG. 2 is a perspective view, showing the central reinforecement cylindrical member and the flanges associated therewith, but without the cardboard reel to which they would usually be fastened.

FIG. 2 shows a cylindrical member 24, preferably in the form of a piece of pipe of plastics material, having a first flange 26 and a second flange 28. Each of these flanges has a boss 33 having an inner opening 34, which is of a size to form a close fit with the outer diameter of the cylindrical member 24. By "close fit", it is meant that the cylindrical member 24 will fit into the opening 34, but be close enough to be sonically welded at that fitting point. Thus, a very strong joint can be formed without the necessity of using an adhesive or a solvent or a spin-welding process, all of which would cause extra expense and expose workers to potentially dangerous vapors or machinery.

The method of assembly involves securing flange 28 to one end of cylindrical member 24, preferably by holding member 24 in a suitable jig on the production line and pressing flange 28 over the end of member 24, and then, by means of the head 27 of a sonic-welded tool which fits into or around the flange, immediately weld the flange 28 so that it becomes bonded to the end of member 24. Preferably, both the cylindrical surface and the annular end surface of the axial member are welded at their interfaces with the confronting surfaces inside the hole in the flange.

As a separate step, a cable reel is assembled in the usual manner, that is by placing end plates 16 and 18 over the ends of a hollow core 14 so that holes 25 in the center of each end plate 16 or 18 are in alignment along the axis of the reel. The holes 25 are of a size to receive the outer surface of boss 33 of flange 26 or 28. The free end 32 of member 24 is then passed through one of the holes 25, through the hollow center of core 14 and through hole 25 in the other end plate 16. Member 24 has been cut to a length so it will be approximately flush with the outer surface of flange 16 when it is installed in place with boss 33 of flange 28, projecting into the hole of flange 18. Flange 28 is then held in predetermined position and flange 26 is pressed against the free end 32 of member 24 so that free end 32 enters and bottoms into hole 34, which, as previously described, is sized to be a close fit. Flange 26 is then welded by means of a sonic welder, the head of which is shown diagrammatically in FIG. 1 which will fit into an adjacent boss 33, causing sonic-induced heating to take place in the close fit joint, and thus melting and fusing the plastics material of flange 26 to the plastics material of the member 24 without the necessity of using any adhesives or spin-welding. The welder head is needed for only momentary contact until the plastic is fused. The welder may, of course, be in other positions adjacent the area to be welded. Thus, production time is greatly reduced and there is no need to have equipment to mechanically rotate a flange to cause spin-welding.

Since the cylindrical member 24 is cut to a length which is approximately equal to the width of the reel, when flange 26 is pressed and sonic-welded into place, the inner surfaces of flanges 26 and 28 will bear tightly against the outer surfaces of end plates 16 and 18, respectively, thus forming an extremely tight and rigid reel structure. The protruding lugs 40 strengthen the joint between the flanges and the end plates. Optionally, the lugs 40 may have hollow centers 41 for engagement of a tool for reeling or unreeling cable or rope from the reel.

In a particular preferred embodiment, end plates 16 and 18 are made of corrugated boxboard material of a diameter of about 14 inches, the core 14 is made of helically wound heavy craft paper material of a diameter of about 5 inches, and the core is about 6 inches long. The cylindrical member 24 and the flanges 26 and 28 are made of high impact polystyrene material, with the flanges each having a diameter of about $3\frac{3}{4}$ inches. The cylindrical member 24 is a hollow pipe with an outer diameter of about 1 inch. Each boss 33 has an outer diameter of $1\frac{1}{4}$ inches and is chamfered toward its end. The outer periphery of the flanges 26 and 28 are also chamfered for a smooth finish. Sonic-welding of the flange to the cylindrical member only required a few tenths of seconds, while the reel was held with the cylindrical member extending in the vertical position. In building this particular embodiment, the second flange was pressed onto the end of the cylindrical member 24 to bottom out in the close fit hole 34, the flange was then sonically welded for 4/10 second and the pressing was continued for an additional 4/10 second to fuse the plastics together. The time would vary depending upon the size of the reel and the plastics material being used. Other plastics could be sonic-welded, such as polypropylene, polyethylene, polyvinylchloride and ABS, etc. If the reel is intended for use in damp locations, the corrugated boxboard may be treated with wax or plastic coating to avoid water absorption.

Although a specific preferred embodiment has been disclosed, it is understood that this is only by way of example and that the scope of this invention is defined by the claims which follow.

I claim:

1. A reel for storage of rope or cable, comprising:

a hollow central cylindrical core having an axial opening therethrough;

a plate at each end of said core secure secured generally perpendicular to the axis of the core, each end plate having a center opening, and means on each end plate to maintain its center in axial alignment with the axis of the core;

reinforcing means holding the end plates securely to the core, comprising:

a cylindrical axial member of plastics material extending through the center opening of both said end plates and through the axial opening of said core, a flange of plastics material secured to each end of the axial member, at least one of said flanges being secured to an end of the axial member by sonic-welding so that both said flange are held in tight contact against the outer surfaces of said end plates and thus reinforce the structural integrity of the reel, wherein said hollow central cylindrical core (14) is fabricated of paperboard material, wherein said plate (16, 18) at each end of said core (14) is fabricated of corrugated paperboard material and has at least one off-center opening means for receipt of a lug element (40), wherein said means (20) on each end plate (16, 18) to maintain its center in axial alignment with the axis of the core (14) is fabricated of corrugated paperboard material and is adhesively secured to each of said end plates (16, 18), wherein each of said flange elements (26, 28) has a central aperture means formed therein by way of a boss (33) having an inner opening means (34) sized so as to receive a free end means (32) of said cylindrical axial member (24) such that said free end means (32) is retained internally of each of said flange elements (26, 28) upon assembly, and means wherein a sonic welder head (27) may be placed in said central aperture means of said flange elements (26, 28) to sonically weld said free end (32) to said opening means (34) of said boss (33) while retaining said free end (32) within the confines of said flange elements (26, 28), wherein each of said flange elements (26, 28) has at least one lug element (40) formed thereon and located off-center from said flange central aperture means, said lug element (40) being sized so as to be retainably received in the off-center opening means formed in said corrugated paperboard plates (16, 18) at each end of said paperboard core (14).

* * * * *